US009598150B2

(12) United States Patent
Hogewoning

(10) Patent No.: US 9,598,150 B2
(45) **Date of Patent: *Mar. 21, 2017**

(54) APPARATUS AND METHOD FOR EXCHANGING A BUOY BEARING ASSEMBLY

(71) Applicant: Orwell Offshore Limited, Woodbridge (GB)

(72) Inventor: Hendricus Hogewoning, Katy, TX (US)

(73) Assignee: Orwell Offshore Limited, Suffolk (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/475,309

(22) Filed: Sep. 2, 2014

(65) Prior Publication Data

US 2015/0203176 A1 Jul. 23, 2015

Related U.S. Application Data

(63) Continuation of application No. 13/562,554, filed on Jul. 31, 2012, now Pat. No. 8,821,202.

(Continued)

(51) Int. Cl.

| | |
|---|---|
| ***B63B 22/02*** | (2006.01) |
| ***B63B 9/00*** | (2006.01) |
| *B63B 21/50* | (2006.01) |

(52) U.S. Cl.

CPC ..... *B63B 22/02* (2013.01); *B63B 9/00* (2013.01); *B63B 22/026* (2013.01);

(Continued)

(58) Field of Classification Search

CPC ..... B63B 22/02

(Continued)

(56) References Cited

U.S. PATENT DOCUMENTS 3,648,311 A * 3/1972 Voss ..... B63B 22/021 141/387
4,082,050 A * 4/1978 van Heijst ..... B63B 22/021 114/294

(Continued)

FOREIGN PATENT DOCUMENTS

WO 03/039946 A1 5/2003
WO 2007/127531 A2 11/2007

OTHER PUBLICATIONS

Chinese Office Action for Application No. 20120287525.6 dated Feb. 2, 2015.

(Continued)

*Primary Examiner* — Lars A Olson
*Assistant Examiner* — Jovon Hayes
(74) *Attorney, Agent, or Firm* — Patterson & Sheridan, LLP

(57) ABSTRACT

A buoy includes a turret coupled to a buoyant body using a bearing assembly; a deckhouse disposed on the buoyant body; and a bearing retainer configured to retain the bearing assembly and to releasably attach to the turret. The buoy may also include a locking mechanism having an inner opening in the turret, an outer opening in the buoyant body, and a locking member configured for insertion through the inner and outer openings. In one embodiment, the inner opening is out of alignment with the outer opening during operation of the buoy. The buoy may further include a detachable cover on the deckhouse, wherein the cover is configured to attach to the bearing retainer.

19 Claims, 8 Drawing Sheets

Related U.S. Application Data

(60) Provisional application No. 61/605,557, filed on Mar. 1, 2012.

(52) U.S. Cl.
CPC ..... *B63B 21/508* (2013.01); *B63B 2009/008* (2013.01); *Y10T 29/49698* (2015.01); *Y10T 29/49819* (2015.01)

(58) Field of Classification Search
USPC ..... 114/230.12, 230.13; 441/3–5
See application file for complete search history.

(56) References Cited

U.S. PATENT DOCUMENTS 4,148,107 A * 4/1979 Karl ..... B63B 22/025 114/230.15
4,279,047 A * 7/1981 van Heijst ..... F16L 27/0832 441/5
4,472,150 A * 9/1984 Tang ..... B63B 22/021 384/281
4,617,000 A * 10/1986 Girardot ..... B63B 22/025 441/3
4,701,143 A * 10/1987 Key ..... B63B 21/507 114/264
4,841,895 A * 6/1989 Brewerton ..... B63B 22/021 114/230.12
5,065,689 A * 11/1991 Krogstad ..... B63B 21/507 114/230.12
5,240,446 A * 8/1993 Boatman ..... B63B 21/508 114/230.2
5,292,271 A * 3/1994 Boatman ..... B63B 21/508 114/230.12
5,305,703 A * 4/1994 Korsgaard ..... B63B 22/023 114/230.1
5,306,186 A 4/1994 Boatman
5,316,509 A 5/1994 Boatman et al.
5,356,321 A * 10/1994 Boatman ..... B63B 21/508 114/230.12
5,363,789 A * 11/1994 Laurie ..... B63B 21/508 114/293
5,372,531 A 12/1994 Boatman et al.
5,468,166 A * 11/1995 Breivik ..... B63B 22/026 114/230.1
5,762,017 A * 6/1998 Groves ..... B63B 21/507 114/230.12
5,816,183 A * 10/1998 Braud ..... B63B 22/023 114/230.13
5,823,131 A * 10/1998 Boatman ..... B63B 21/508 114/230.12
5,893,784 A * 4/1999 Boatman ..... B63B 21/507 114/230.12
6,164,233 A * 12/2000 Pollack ..... B63B 21/507 114/230.12
6,176,193 B1 * 1/2001 Whitby ..... B63B 9/04 114/230.12
6,698,372 B2 * 3/2004 Hobdy ..... B63B 21/507 114/230.12
7,510,452 B2 * 3/2009 Van Tol ..... B63B 21/508 441/5
7,513,208 B1 * 4/2009 Seaman ..... B63B 21/508 114/230.12
7,717,762 B2 * 5/2010 Boatman ..... B63B 21/508 114/230.1
7,985,110 B2 * 7/2011 Ingebrigtsen ..... B63B 21/508 114/230.12
8,342,777 B2 * 1/2013 Baylot ..... B63B 21/508 114/230.13
8,821,202 B2 * 9/2014 Hogewoning ..... B63B 9/00 114/230.12
2010/0012010 A1 1/2010 Gooijer et al.
2013/0231015 A1 * 9/2013 Hogewoning ..... B63B 9/00 441/5

OTHER PUBLICATIONS

Singapore Search Report and Written Opinion for Application No. 201206220-4 dated Sep. 24, 2013.
EP Search Report for Application No. 1218269.7-1751/2634078 dated Apr. 8, 2014.

* cited by examiner

APPARATUS AND METHOD FOR EXCHANGING A BUOY BEARING ASSEMBLY

CROSS-REFERENCE TO RELATED APPLICATIONS

This application is a continuation of U.S. patent application Ser. No. 13/562,554, filed Jul. 31, 2012, which claims benefit of U.S. provisional patent application Ser. No. 61/605,557, filed Mar. 1, 2012, which is herein incorporated by reference in their entirety.

BACKGROUND OF THE INVENTION

Field of the Invention

Embodiments of the present invention generally relate to a buoy. In particular, embodiments of the present invention relate to an apparatus and method of replacing a bearing assembly of a buoy.

Description of the Related Art

Mooring assemblies have been used as an interconnect and a mooring point for vessels loading or unloading gas or liquid products. The mooring assembly may include a buoyant body rotatably coupled to a turret using a bearing assembly. The turret is geostationally fixed while the buoyant body is free to weathervane around the turret. Therefore, the bearing assembly is an important component of the mooring assembly.

When the bearing assembly is damaged, the process of repairing the bearing assembly is generally a complicated operation. In some instances, the mooring assembly may transfer to another location for repair. Such operations are often costly due to production down time.

There is a need, therefore, for a method of removing a bearing assembly from a mooring assembly for repair or replacement at an offshore location. There is also a need for a mooring assembly configured to allow repair or replacement of a bearing assembly while located offshore.

SUMMARY OF THE INVENTION

In one embodiment, a method of removing a bearing assembly from the buoy includes providing the buoy with a bearing assembly for coupling a buoyant body to a turret and a bearing retainer configured to retain the bearing assembly and to releasably attach to the turret. The method also includes releasably attaching the bearing retainer to the turret; coupling the bearing retainer to the bearing assembly; releasing the bearing assembly from the buoyant body and the turret; and removing the bearing retainer and the bearing assembly from the buoy. The method may also include lifting the turret relative to the buoyant body and locking the turret to the buoyant body.

In another embodiment, a buoy includes a turret coupled to a buoyant body using a bearing assembly; a deckhouse disposed on the buoyant body; and a bearing retainer configured to retain the bearing assembly for transport and to releasably attach to the turret. The buoy may also include a locking mechanism having an inner opening in the turret; an outer opening in the buoyant body; and a locking member configured for insertion through the inner and outer openings. In one embodiment, the inner opening is out of alignment with the outer opening during operation of the buoy. The buoy may further include a detachable cover on the deckhouse, wherein the cover is configured to attach to the bearing retainer.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 4 shows the bearing retainer and the bearing assembly being lifted toward a cover.

FIG. 5 shows the bearing retainer, the bearing assembly, and the cover being lifted toward a vessel.

DETAILED DESCRIPTION

Figure 1:
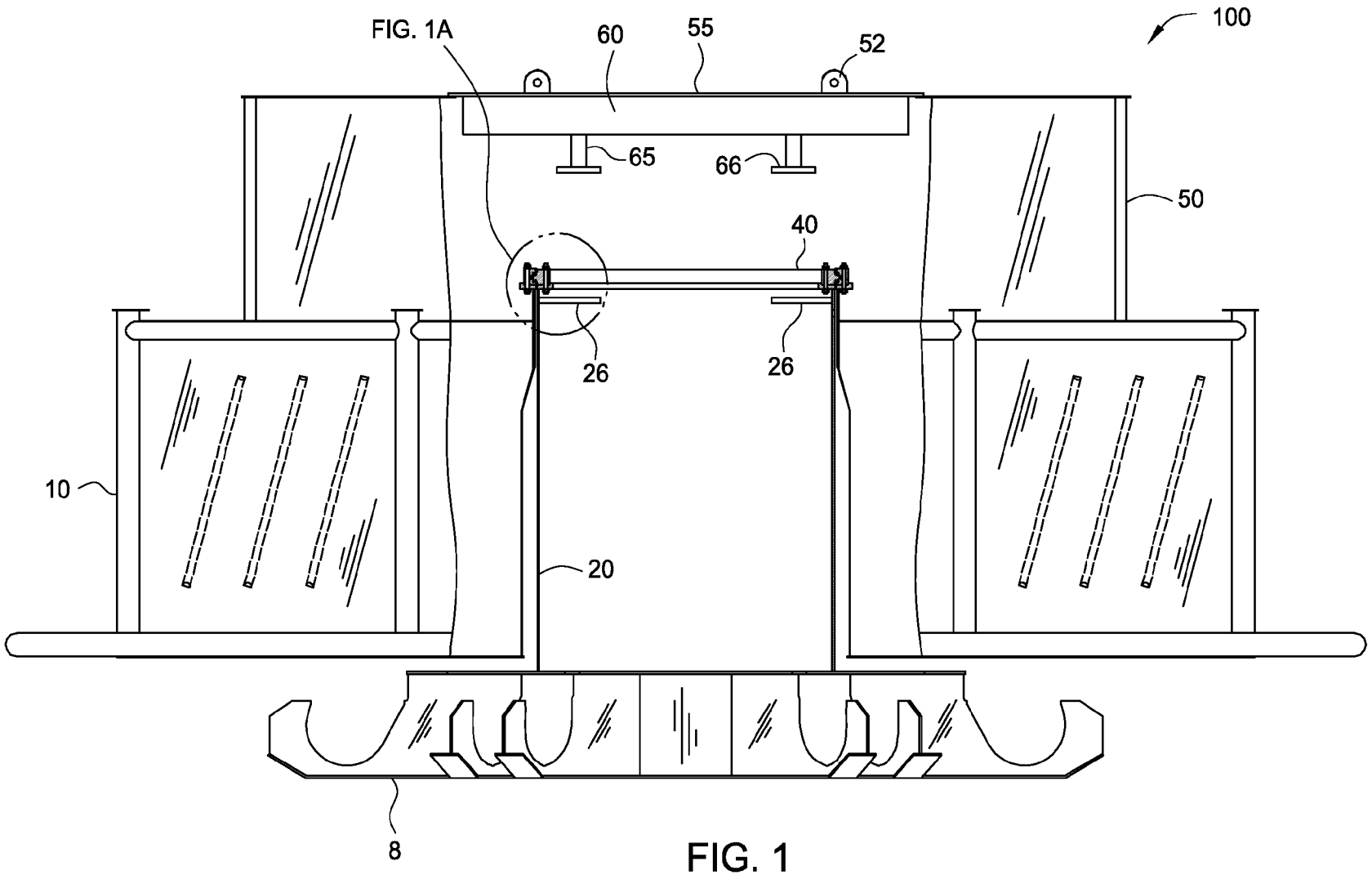
FIG. 1 shows a partial cross-sectional view of an exemplary embodiment of a buoy.

FIG. 1 shows an exemplary embodiment of a mooring assembly such as a catenary anchor leg mooring ("CALM") buoy 100. FIG. 1 shows a perspective view with a partial cross-sectional view of the buoy 100. The buoy 100 may include a buoyant body 10 rotatably coupled to a turret 20. The buoyant body 10 is configured to be partially submerged in water. As shown, the buoyant body 10 has a hexagonal shape, although any suitable shape is contemplated. For example, the shape of the buoyant body 10 may be, including but not limited to, a square, circle, pentagon, or octagon.

The turret 20 is positioned inside the buoyant body 10. A chain table 8 is attached to the lower end of the turret 20. Catenary anchor chains may be attached to the chain table 8 to anchor the buoy 100. Other exemplary anchoring devices include a chain, a steel wire, a polyester chain, and combinations thereof. For example, in deep water, a combination of steel chains and steel wire or a combination of steel chains and polyester chains may be used to anchor the buoy. The turret 20 may include a support bracket 26 to facilitate handling of the turret 20. For example, the support bracket 26 may be engaged in order to lift or lower the turret 20. In one embodiment, the support bracket 26 is a short platform extending radially inward. Any suitable number of support brackets may be provided, for example, two, four, six, or eight. In one example, six support brackets 26 may be circumferentially spaced apart in the turret 20. The turret 20 may also include other components such as a swivel.

Figure 1A:
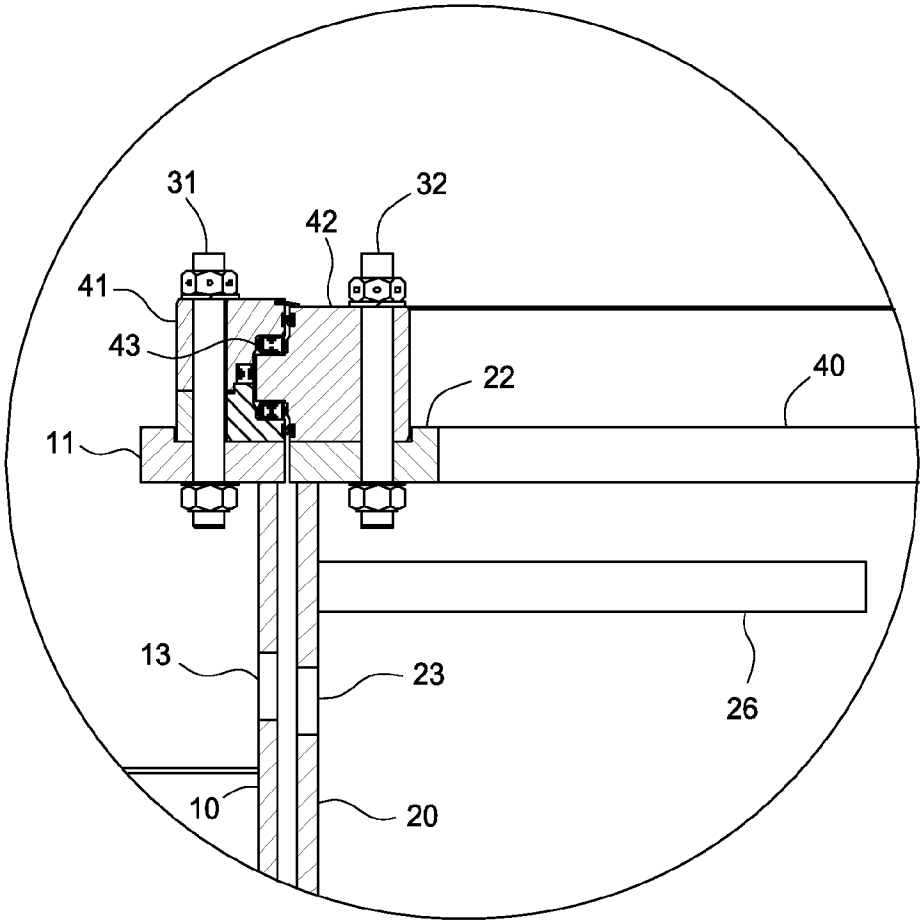
FIG. 1A is an enlarged partial view of the buoy of FIG. 1.

The buoyant body 10 is rotatably coupled to the turret 20 using a bearing assembly 40. The bearing assembly 40 includes an outer ring 41 coupled to an inner ring 42 using bearing devices 43 such as ball bearings or three race roller bearings. As shown in FIG. 1A, the outer ring 41 is attached to an outer flange 11 of the buoyant body 10, and the inner ring 42 is attached to an inner flange 22 of the turret 20. In one embodiment, the inner and outer rings 41, 42 are attached to the respective inner and outer flanges 11, 22 using a plurality of inner and outer bolts 31, 32. The inner and outer rings 41, 42 may optionally sit in a recess on the flanges 11, 22.

A deckhouse 50 is disposed above the turret 20 and the buoyant body 10. The deckhouse 50 may have a smaller size than the buoyant body 10 and may have the same or a different shape than the buoyant body 10. In one embodiment, a detachable cover 55 is provided in the ceiling of the deckhouse 50. A plurality of lift brackets 52 are disposed on the outer surface of the deckhouse 50 for receiving a cable or other lifting mechanism.

A bearing retainer 60 is provided for retaining the bearing assembly 40 to facilitate transport of the bearing assembly 40. In one embodiment, the bearing retainer 60 is initially releasably connected to the cover 55. The bearing retainer 60 is configured to attach to a plurality of locations on the bearing assembly 40. For example, the bearing retainer 60 may be an adapter beam having two or more ends that are attachable to the bearing assembly 40. In another embodiment, the bearing retainer 60 may be an adapter beam having six ends arranged like a spoke. In this respect, the bearing retainer 60 may attach to the bearing assembly 40 at six different locations. It contemplated that the adapter beam may include any suitable number of spoke ends, such as four, five, or eight ends. In another example, the bearing retainer 60 may be a polygon such as a square, pentagon, hexagon, or octagon. In this example, the bearing retainer 60 may attach to the bearing assembly 40 at the "corners" of the polygon. In yet another example, the bearing retainer 60 may be a ring having substantially the same diameter as the bearing assembly 40 and at least one cross-beam. In this example, the bearing assembly 40 may attach to the ring of the bearing retainer 60. In one embodiment, the adapter beam may have a flange at it lower end for attachment to the bearing assembly 40. The flange of the adapter beam may have openings configured to align with the openings in the inner and outer rings 41, 42 to receive bolts 31, 32.

The bearing retainer 60 also includes a plurality of connector stands 65. The connector stands 65 are configured to attach to the support bracket 26 on the turret 20. In one embodiment, the connector stands 65 extend below the bearing retainer 60 and include a flange 66 on the lower end. Each connector stand 65 may be attached to the support bracket 26 using a bolt 62 or other suitable attachment members.

In one embodiment, the buoy 100 may optionally include a locking mechanism to rotationally and axially lock the turret 20 to the buoyant body 10. As shown in FIG. 1A, turret 20 may include an inner lock opening 23 that can be coupled to an outer lock opening 13 in the buoyant body 10 using a locking member 80. During normal operation of the buoy 100, the inner lock opening 23 is out of alignment with the outer lock opening 13. To align the openings 13, 23, the turret 20 is raised relative to the buoyant body 10. The turret 20 may be raised using hydraulics, mechanics, buoyancy, and combinations thereof. For example, mechanical or hydraulic jacks 70 may be used to raise the turret 20 relative to the buoyant body 10. The locking member 80, such as a locking pin, may be inserted through both openings 13, 23 after alignment, thereby rotationally and axially locking the turret 20 to the buoyant body 10. As shown, the openings 13, 23 are positioned above the floor of the deckhouse 50. However, it is contemplated that the openings 13, 23 may be positioned below the floor of the deckhouse 50, or the openings 13, 23 may be provided above and below the floor of the deckhouse 50. A plurality of locking pins and openings 13, 23 may be used to lock the turret 20 to the buoyant body 10.

Figure 2:
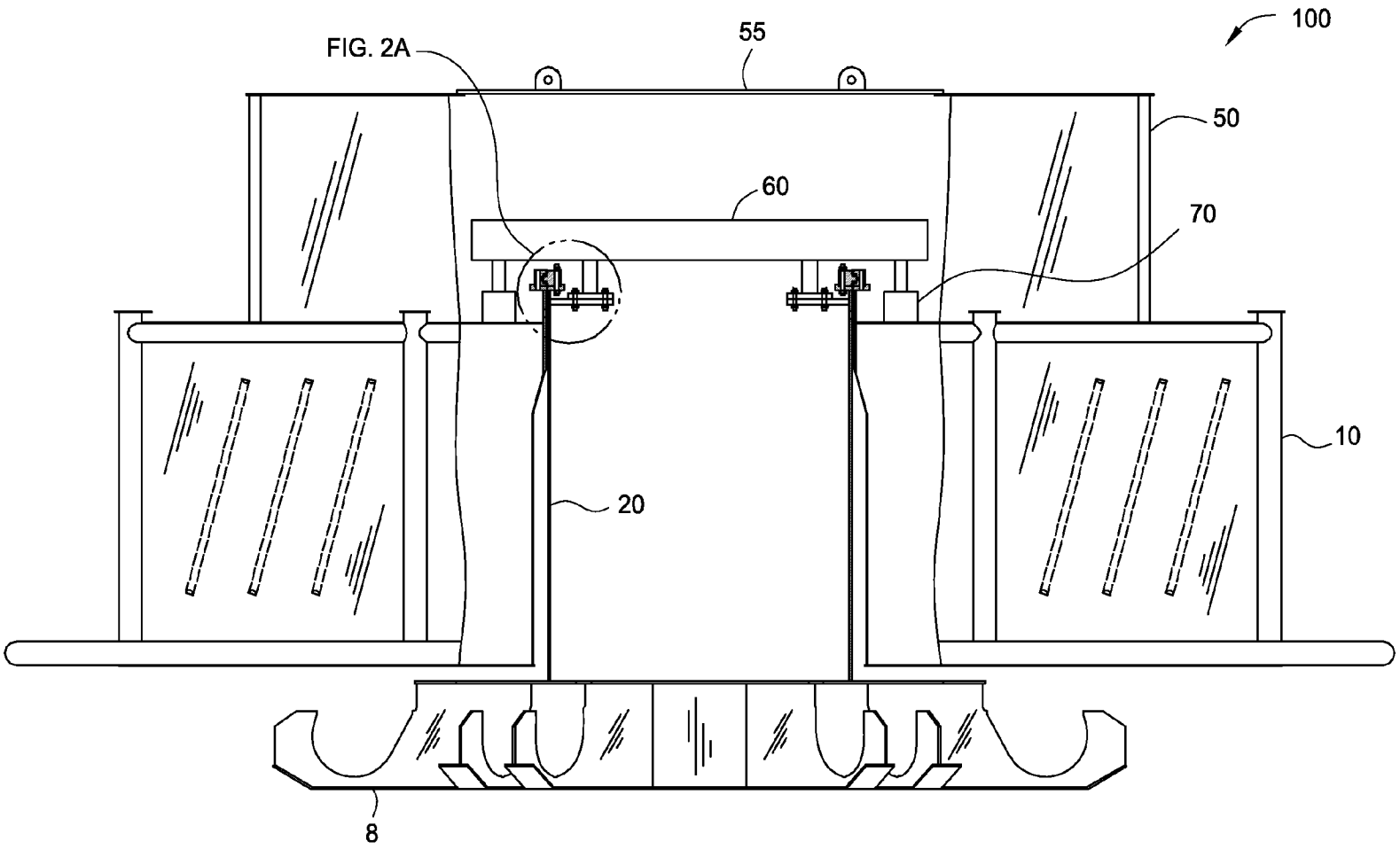
FIG. 2 shows a partial cross-sectional view of the buoy of FIG. 1 during an exemplary bearing assembly removal process.
Figure 2A:
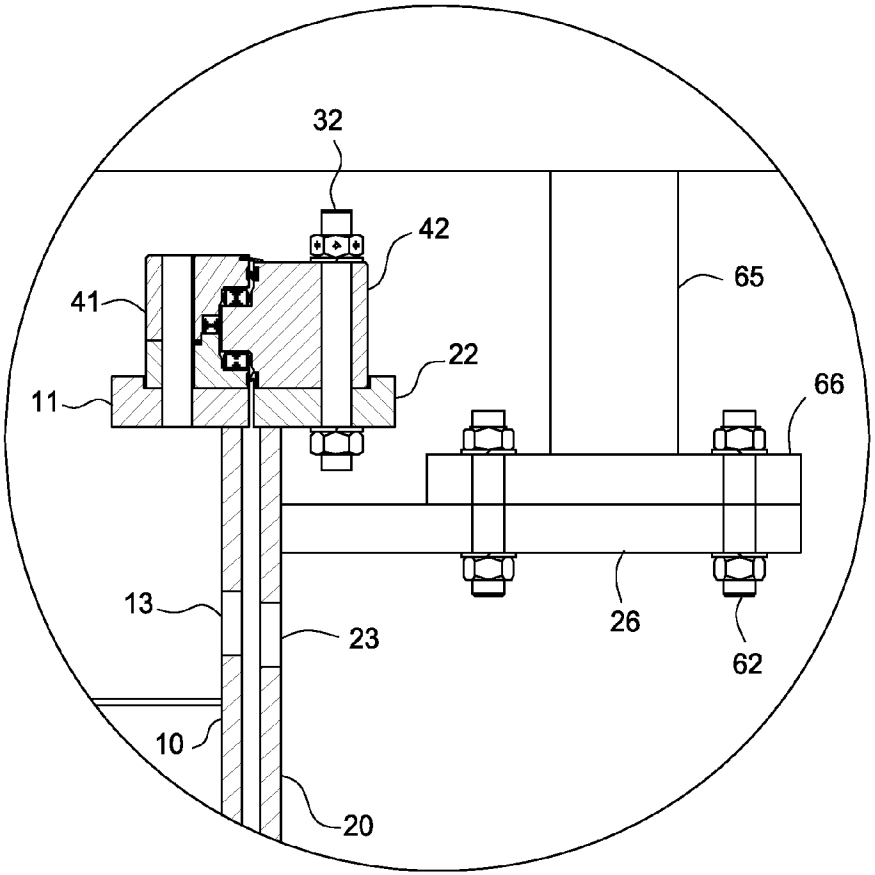
FIG. 2A is an enlarged partial view of the buoy of FIG. 2 and shows the bearing retainer attached to the bearing assembly.

During operation of the buoy 100, the bearing assembly 40 may require repair or replacement. Before removing the bearing assembly 40, the turret 20 is rotationally locked to the buoyant body 10. In one embodiment, a plate attached to the bearing assembly 40 may be coupled to a vertical pin connected to the floor of the buoyant body 10 to rotationally lock the turret 20 to the buoyant body 10. A plurality of plate and pin locking devices may be used to rotationally lock the turret. To remove the bearing assembly 40, the bearing retainer 60 is released from the cover 55 and lowered toward the bearing assembly 40, as shown in FIGS. 2 and 2A. A conveyor such as a chain, a cable, a hydraulic cylinder, or a winch may be used to lower the bearing retainer 60. The conveyor may be manually, electrically, hydraulically, or pneumatically operated. Any component that may be an obstacle should be removed prior to lowering the bearing retainer 60. For example, a swivel connected to the turret 20 should be removed if it prevents the attachment of the bearing retainer 60 to the bearing assembly 40. The bearing retainer 60 may be lowered onto a plurality of hydraulic or mechanical jacks 70. The jacks 70 may be positioned on the floor of the deckhouse 50 around the outside of the bearing assembly 40. In another embodiment, the jacks 70 may be positioned inside the turret 20. The bearing retainer 60 may include a receptacle such as a recess for engaging the jacks 70. Any suitable number of jacks 70 may be used to support the bearing retainer 60. As shown, the bearing retainer 60 is an adapter beam having six spoke ends, and a jack 70 is provided to engage each of the spoke ends. If a ring is used as a bearing retainer, then the jacks 70 may engage and support the ring.

Then, the bearing retainer 60 is attached to the bearing assembly 40. In this respect, the connector stand 65 is attached to the support bracket 26 of the turret 20 by bolting the flange 66 of the connector stand 65 to the support bracket 26. It must be noted that, in another embodiment, the jacks 70 may be placed under the bearing retainer 60 after the bearing retainer 60 lands on the support bracket 26 or attaches to the support bracket 26. Thereafter, the outer bolts 31 connecting the outer ring 41 of the bearing assembly 40 to the buoyant body 10 are removed.

Figure 3:
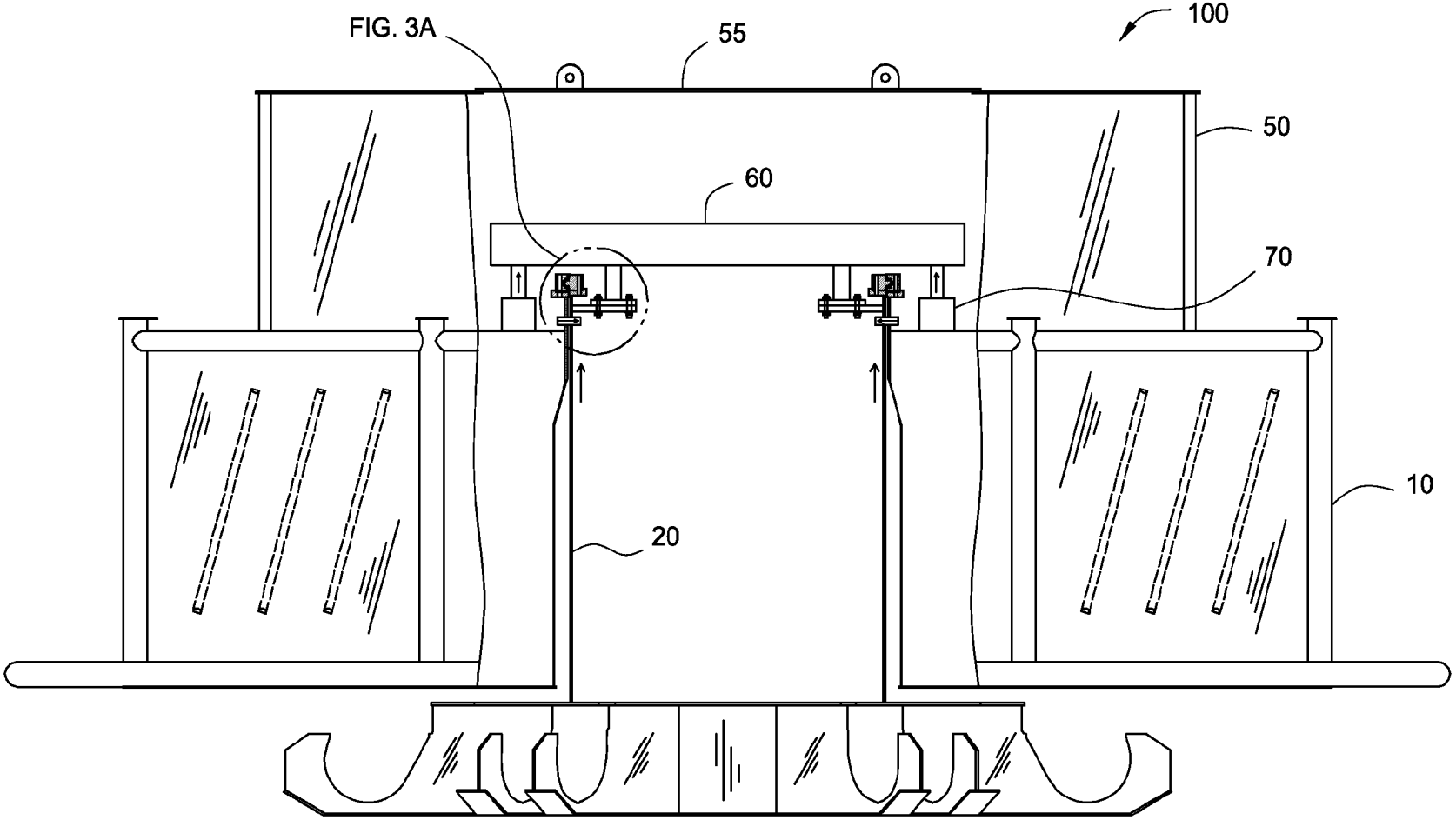
FIG. 3 shows a partial cross-sectional view of the buoy of FIG. 1 during an exemplary bearing assembly removal process.
Figure 3A:
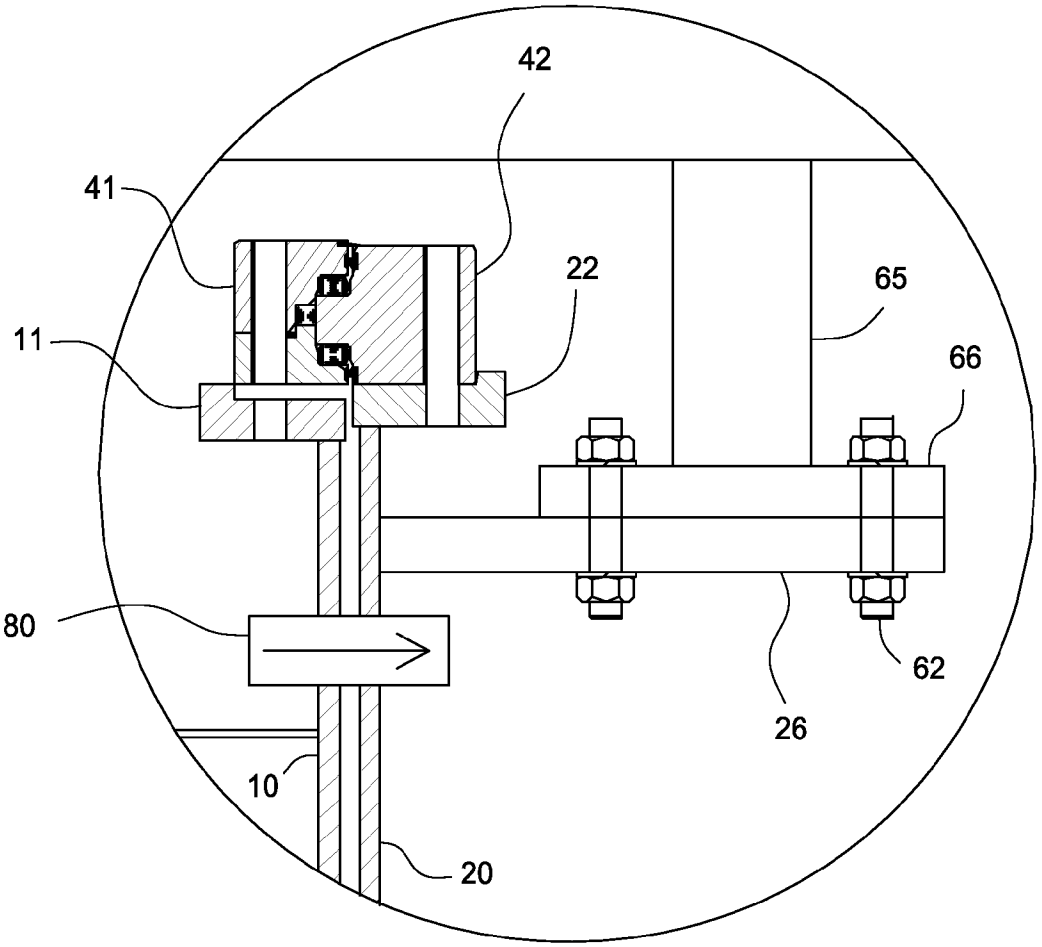
FIG. 3A is an enlarged partial view of the buoy of FIG. 3 and shows the turret locked to the buoyant body.

Referring now to FIGS. 3 and 3A, the hydraulic or mechanical jacks 70 are actuated to slightly lift the bearing retainer 60. In turn, the turret 20 is raised relative to the buoyant body 10, thereby placing the inner locking opening 23 into alignment with the outer locking opening 13. A locking pin 80 is then inserted through both openings 13 and 23 to axially lock the turret 20 to the buoyant body 10. The locking pin 80 may also assist with rotationally locking the turret 20 to the buoyant body 10. FIG. 3A shows the existence of a gap between the outer ring 41 of the bearing assembly 40 and the flange 11 of the buoyant body 10 as a result of raising the turret 20. In another embodiment, instead of removal, the outer bolts 31 are loosened sufficiently to allow the turret 20 to be lifted to align the openings 13, 23. In one example, the outer bolts 31 are loosened sufficiently to allow the turret 20 to be lifted at least 7 mm; preferably, at least 12 mm.

Figure 4:
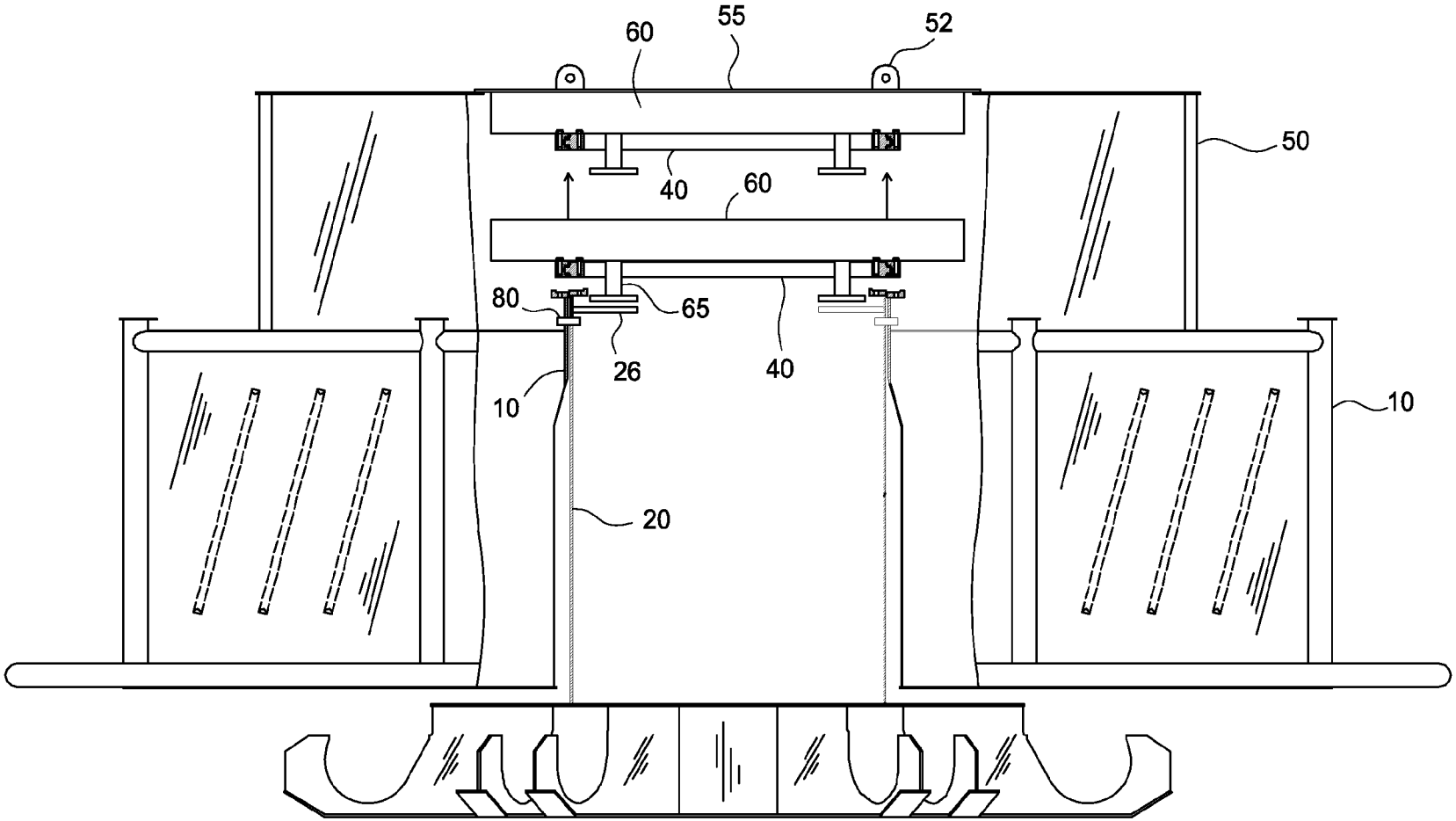
FIG. 4 shows a partial cross-sectional view of the buoy of FIG. 1 during an exemplary bearing assembly removal process.

Referring to FIG. 4, after locking the turret 20, the bearing retainer 60 is lowered by lowering the jacks 70 until the weight of the turret 20 is carried by the locking pins 80, then the outer bolts 31, if not already removed, and the inner bolts 32 are removed to disconnect the bearing assembly 40 from the turret 20 and the buoyant body 10. Thereafter, the connector stand 65 is disconnected from the support bracket 26 of the turret 20. The bearing retainer 60 is then lowered on to the bearing assembly 40, which is then attached to the adapter beam of the bearing retainer 60. For example, the outer ring 42 and the inner ring 41 may be bolted to the adapter beam. The bearing retainer 60 and the attached bearing assembly 40 may now be raised by the conveyor to the cover 55. Then, the bearing retainer 60 is re-attached to the cover 55.

Figure 5:
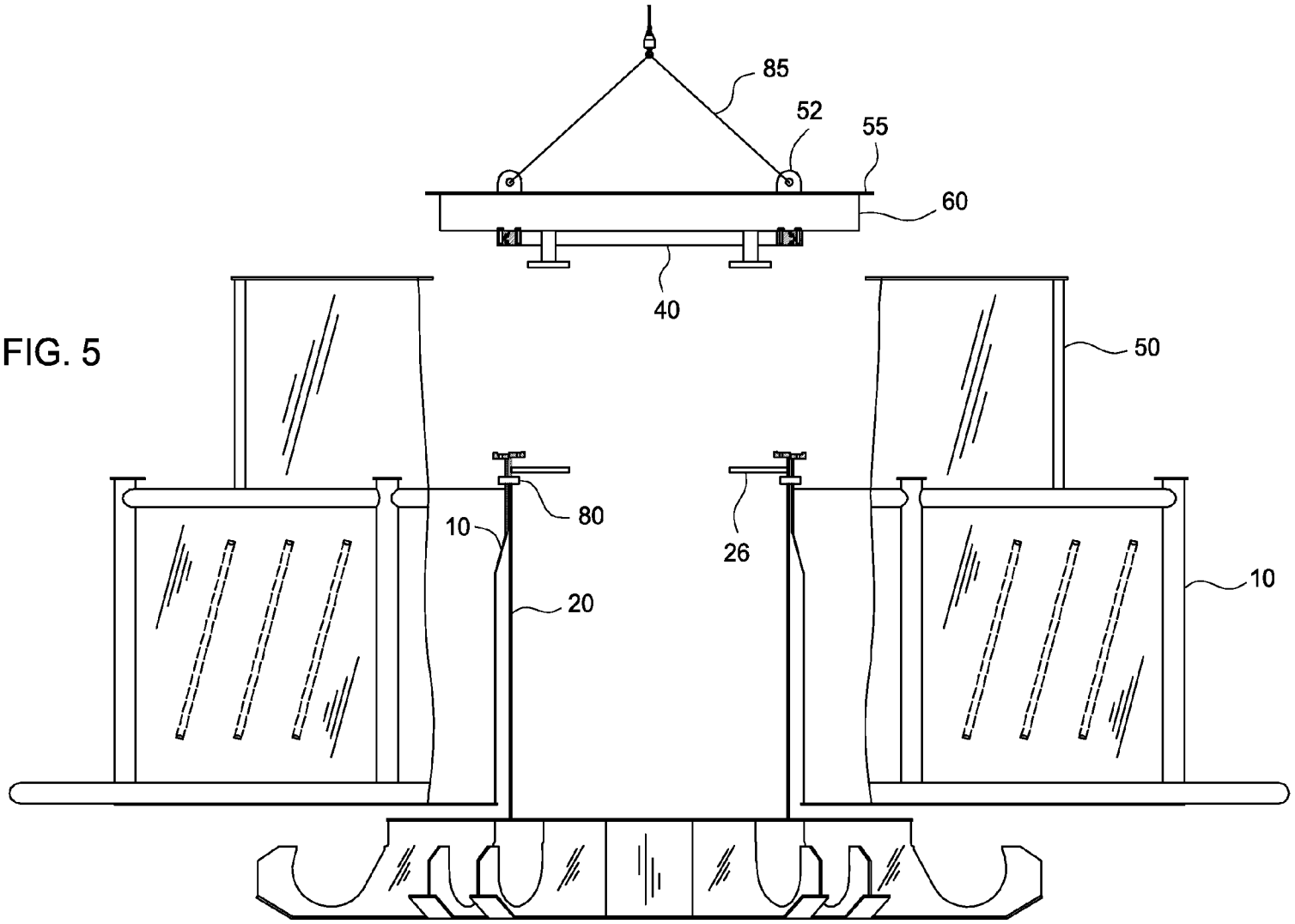
FIG. 5 shows a partial cross-sectional view of the buoy of FIG. 1 during an exemplary bearing assembly removal process.

As shown in FIG. 5, another conveyor 85 such as a chain or cable is attached to the lift brackets 52 of the cover 55. A crane may be used to move the cover 55, the bearing retainer 60, and the bearing assembly 40 to another vessel, where the bearing assembly 40 can be replaced or repaired.

After the bearing assembly 40 has been replaced or repaired, the process may be performed in reverse to install the bearing assembly 40 in the buoy 100.

In another embodiment, the step of lifting the turret 20 relative to the buoyant body 10 may be omitted. Elevation of the turret 20 may be performed to facilitate reinstallation of the bearing assembly 40, and thus, is not a requisite step during the removal process. Therefore, after attaching the connector stand 65 of the bearing retainer 60 to the support bracket 26 of the turret 20, the inner and outer bolts 31, 32 may be removed to disconnect the inner and outer rings 41, 42 of the bearing assembly 40 from the turret 20 and the buoyant body 10. The bearing assembly 40 is then attached to the adapter beam of the bearing retainer 60. Then, the connector stand 65 is disconnected from the support bracket 26. The bearing retainer 60 and the bearing assembly 40 are lifted toward and attached to the cover 55 for transport to another vessel.

In another embodiment, the buoy 100 may be configured in other suitable ways to facilitate removal of the bearing assembly 40 from the buoy 100. For example, instead of the detachable cover 55, the buoy 100 may be equipped with a side door sufficiently sized to allow removal of the bearing assembly 40. In another example, the deckhouse 50 may have one or more removable walls. In yet another example, the deckhouse 50 may be releasable connected to the buoyant body 10. During operation, the deckhouse 50 may be removed to allow transport of the bearing retainer 60 and the bearing assembly 40.

In yet another embodiment, a plurality of guides may be provided on the deckhouse 50 to facilitate alignment of the cover 55 to the deckhouse 50 during reinstallation. For example, cone shaped guides may be placed around the deckhouse 50 to help center the cover 55 to the deckhouse 50.

In one embodiment, a method of removing a bearing assembly from a buoy, wherein the buoy includes a buoyant body rotatably coupled to a turret; the method include providing a bearing retainer configured to retain the bearing assembly and to releasably attach to the turret; attaching the bearing retainer to the turret; coupling the bearing retainer to the bearing assembly; releasing the bearing assembly from the buoyant body and the turret; and removing the bearing retainer and the bearing assembly from the buoy.

While the foregoing is directed to embodiments of the present invention, other and further embodiments of the invention may be devised without departing from the basic scope thereof, and the scope thereof is determined by the claims that follow.

The invention claimed is:

1. A method of removing a bearing assembly from a buoy, the buoy having a buoyant body rotatably coupled to a turret, the method comprising:

providing a bearing retainer configured to retain the bearing assembly and to releasably attach to the turret;

coupling the bearing retainer to the bearing assembly; and releasing the bearing assembly from the buoyant body and the turret.

2. A buoy, comprising:

a buoyant body;

a turret;

a bearing assembly rotatably coupling the buoyant body to the turret; and a bearing retainer configured to attach to the turret and to attach to a plurality of locations on the bearing assembly.

3. The buoy of claim 2, further comprising a locking mechanism for rotationally and axially locking the turret to the buoyant body.

4. The buoy of claim 3, wherein the locking mechanism includes:

an inner opening in the turret;

an outer opening in the buoyant body; and a locking member configured for insertion through the inner and outer openings.

5. The buoy of claim 4, wherein the inner opening is out of alignment with the outer opening during operation of the buoy.

6. The buoy of claim 2, wherein the bearing retainer comprises an adapter beam having at least two ends configured to attach to the bearing assembly.

7. The buoy of claim 2, further comprising a deckhouse releasably attached to the buoyant body to allow for removal of the bearing retainer and the bearing assembly.

8. The buoy of claim 7, wherein the bearing retainer is attached to the deckhouse prior to retaining the bearing assembly.

9. The buoy of claim 7, further comprising a detachable cover on the deckhouse, the cover configured to attach to the bearing retainer.

10. The buoy of claim 7, wherein the deckhouse is rotatable with the buoyant body.

11. The buoy of claim 7, further comprising an opening in the deckhouse for removing the bearing retainer.

12. The buoy of claim 2, wherein the turret is configured to anchor the buoyant body.

13. The buoy of claim 2, wherein the bearing retainer comprises an adapter.

14. The buoy of claim 13, wherein the adapter comprises a polygon or a ring.

15. A buoy, comprising:

a buoyant body;

a turret;

a bearing assembly rotatably coupling the buoyant body to the turret; and a bearing lifting structure configured to attach to a plurality of locations on the bearing assembly to transport the bearing assembly.

16. The buoy of claim 15, further comprising a locking mechanism for rotationally and axially locking the turret to the buoyant body.

17. The buoy of claim 16, wherein the locking mechanism includes:

an inner opening in the turret;

an outer opening in the buoyant body; and a locking member configured for insertion through the inner and outer openings.

18. The buoy of claim 15, further comprising a deckhouse releasably attached to the buoyant body to allow for removal of the bearing retainer and the bearing assembly.

19. The buoy of claim 15, wherein the bearing retainer comprises an adapter having a polygonal shape or a ring shape.

* * * * *